US011172562B2

(12) United States Patent
Magielse et al.

(10) Patent No.: US 11,172,562 B2
(45) Date of Patent: Nov. 9, 2021

(54) LIGHTING CONTROL

(71) Applicant: SIGNIFY HOLDING B.V., Eindhoven (NL)

(72) Inventors: Remco Magielse, Tilburg (NL); Antonie Leonardus Johannes Kamp, San Francisco, CA (US); Leendert Teunis Rozendaal, Valkenswaard (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 418 days.

(21) Appl. No.: 16/334,472

(22) PCT Filed: Sep. 11, 2017

(86) PCT No.: PCT/EP2017/072696
§ 371 (c)(1),
(2) Date: Mar. 19, 2019

(87) PCT Pub. No.: WO2018/054705
PCT Pub. Date: Mar. 29, 2018

(65) Prior Publication Data

US 2021/0282248 A1 Sep. 9, 2021

(30) Foreign Application Priority Data

Sep. 20, 2016 (EP) ..... 16189575

(51) Int. Cl.
*H05B 47/00* (2020.01)
*H05B 47/17* (2020.01)
*H05B 47/175* (2020.01)

(52) U.S. Cl.
CPC ..... *H05B 47/17* (2020.01); *H05B 47/175* (2020.01)

(58) Field of Classification Search
CPC ..... H05B 47/00; H05B 47/10; H05B 47/17; H05B 47/175; H05B 47/19; G06F 3/048; G06F 3/0482; G06F 3/0484; G06F 3/0487
See application file for complete search history.

(56) References Cited

U.S. PATENT DOCUMENTS 6,300,727 B1 10/2001 Bryde et al.
2003/0025840 A1* 2/2003 Arling ..... G08C 17/00 348/734

(Continued)

FOREIGN PATENT DOCUMENTS

FR 3007236 A1 12/2014
WO 2014049473 A1 4/2014

(Continued)

*Primary Examiner* — Thai Pham

(57) ABSTRACT

A system comprising: a controller configured to apply at least one illumination setting to at least one illumination source, thereby causing the illumination source to emit light according to the applied illumination setting; electronic storage accessible to the controller; and a locking device configured to generate a lock command pertaining to the applied illumination setting, wherein the system is configured to mark the illumination setting as locked in the electronic storage in response to the lock command; wherein the controller is configured to receive a control command pertaining to the applied illumination setting, and modify the applied illumination setting according that control command unless the illumination setting is marked as locked when it is received, wherein the illumination setting is not modified in response to that control command in that event.

15 Claims, 6 Drawing Sheets

(56) References Cited

U.S. PATENT DOCUMENTS

| | | | | |
|---|---|---|---|---|
| 2005/0200598 | A1* | 9/2005 | Hayes | H04B 1/202 345/156 |
| 2007/0273307 | A1 | 11/2007 | Westrick et al. | |
| 2013/0271004 | A1* | 10/2013 | Min | H05B 45/00 315/112 |
| 2014/0380234 | A1* | 12/2014 | Shim | G06F 3/0488 715/781 |
| 2015/0035437 | A1 | 2/2015 | Panopoulos et al. | |
| 2015/0226406 | A1* | 8/2015 | Lashina | H05B 47/11 362/235 |
| 2016/0091217 | A1 | 3/2016 | Verberkt et al. | |
| 2016/0360594 | A1* | 12/2016 | Chemel | H05B 47/115 |
| 2017/0367164 | A1* | 12/2017 | Engelen | H04L 12/2825 |

FOREIGN PATENT DOCUMENTS

| | | | |
|---|---|---|---|
| WO | 2014204286 | A1 | 12/2014 |
| WO | 2015054611 | A1 | 4/2015 |
| WO | 2016088006 | A1 | 6/2016 |

* cited by examiner

LIGHTING CONTROL

CROSS-REFERENCE TO PRIOR APPLICATIONS

This application is the U.S. National Phase application under 35 U.S.C. § 371 of International Application No. PCT/EP2017/072696, filed on Sep. 11, 2017, which claims the benefit of European Patent Application No. 16189575.0, filed on Sep. 20, 2016. These applications are hereby incorporated by reference herein.

TECHNICAL FIELD

The present disclosure relates to systems and methods for controlling luminaires, i.e. lighting devices, to render a lighting scene in an environment.

BACKGROUND

Electronic devices are becoming ever more connected. A "connected" device refers to a device—such as a user terminal, or home or office appliance or the like—that is connected to one or more other such devices via a wireless or wired connection in order allow more possibilities for control of the device. For instance, the device in question is often connected to the one or more other devices as part of a wired or wireless network, such as a Wi-Fi, ZigBee or Bluetooth network. The connection may for example allow control of the device from one of the one or more other devices, e.g. from an app (application) running on a user device such as a smart phone, tablet or laptop; and/or may allow for sharing of sensor information or other data between the devices in order to provide more intelligent and/or distributed automated control.

In recent years, the number of connected devices has increased dramatically. Lighting systems are part of this movement towards a connected infrastructure. Conventional connected lighting systems consist of fixed light sources, which can be controlled through wall-mounted switches, dimmers or more advanced control panels that have pre-programmed settings and effects, or even from an app running on a user terminal such as a smart phone, tablet or laptop. For example, this may allow user to create an ambiance using a wide range of colored lighting, dimming options and/or dynamic effects. In terms of control the most common approach is to replace a light switch with a smart-phone based app that offers extended control over lighting (for example Philips hue, LIFX, etc.).

A lighting scene is a particular overall lighting effect in an environment rendered by the light sources in that environment. E.g. a "sunset" scene may be defined in which the light sources are set to output hues in the red-yellow range of the visible spectrum. Each light source may for example output the different hues (or other setting such as saturation or intensity), or a scene may be rendered by all (or some) lights rendering a single color or similar colors. Note that lighting scenes may be dynamic in that the output of one or more light source changes over time.

Connected lighting systems are able to render lighting scenes by receiving lighting instructions over the network (e.g. a ZigBee network) from, for example, a user device such as a smart phone, and interpret the lighting instructions in order to determine the appropriate lighting settings for each light source in order that the lighting system renders a desired lighting scene in the environment.

SUMMARY

In connected lighting systems, control over the luminaires can generally come from multiple sources (e.g. user input, timers, and sensor input) and therefore the possibility for conflicting commands arises which may result in the luminaires changing lighting scene more often than desirable. User input in particular may come from multiple sources such as a first and second user with respective user devices. In such large systems of applications and control devices, it may be a burden (or sometimes even impossible) to 'disable' all these behaviors for a short period of time. The user may want to disable such behaviors, for example, because he is doing an activity that is outside of his regular routine, or he does not want to be disturbed (such as a "meditation session").

The present invention solves this problem by allowing the user means to "lock" the state of the luminaires for a period of time in which the luminaire settings are "frozen". The lock may be a "hard lock" in which the output of the luminaires is frozen at the specific setting which was being rendered at the time of the freeze, i.e. the brightness, hue, and saturation settings of each luminaire are frozen. Alternatively, the lock may be a "soft lock" in which the scene being rendered by the luminaires is frozen, with any dynamic effects of that scene being unchanged. The lock can also be selective wherein only certain types of control command are ignored.

Hence, according to a first aspect disclosed herein there is provided a system comprising: a controller configured to apply at least one illumination setting to at least one illumination source, thereby causing the illumination source to emit light according to the applied illumination setting; electronic storage accessible to the controller; and a locking device configured to generate a lock command pertaining to the applied illumination setting, wherein the system is configured to mark the illumination setting as locked in the electronic storage in response to the lock command; wherein the controller is configured to receive a control command pertaining to the applied illumination setting, and modify the applied illumination setting according that control command unless the illumination setting is marked as locked when it is received, wherein the illumination setting is not modified in response to that control command in that event.

Preferably, the controller is configured to apply the illuminations setting to the luminaire in response to a control command generated by the locking device. Preferably, the locking device comprises a plurality of user interface (UI) elements and is configured to generate that control command in response to actuation of one of the user input elements, and to generate the lock command in response to immediate actuation of the same user interface element.

Note "immediate" in this context refers to order of actuation (i.e. none of the other UI elements are actuated in between), not the relative timing as such. However, in some embodiments the illumination setting may only be marked as locked by the system if the immediate actuation occurs within a predetermined duration of the actuation that causes the illumination setting to be applied.

In embodiments, the illumination source and the controller are embodied in a luminaire of the system, the control command being received at the luminaire.

In embodiments, the illumination source is embodied in a luminaire of the system, and the controller is embodied in a central control device of the system, wherein the control command is received at the central control device and the controller of the central control device is configured to modify the applied illumination setting by transmitting a message to the luminaire.

In embodiments, the controller is configured to receive a control command pertaining to the illumination setting, and identify a type of the control command; wherein the controller is configured to modify the illumination setting according to a first type of control command only if the illumination setting is not marked as locked when that type control command is received; and wherein the controller is configured to modify the illumination setting according to a second type of control command irrespective of whether the illumination setting is marked as locked when that type of control command is received.

In embodiments, the type is identified by identifying whether the command was generated automatically or by a user, the first type of control command being an automatically-generated control command, and the second type of control command being a user-generated control command.

In embodiments, the type is identified by identifying a source of the control command.

In embodiments, the type is identified by determining whether the command complies with a locking protocol, the first type of control command being a control command that does not comply with the locking protocol, the second type of control command being a control command that does comply with the locking protocol.

In embodiments, the system is configured, in response to a control command generated by the locking device and received at the controller when the illumination setting is marked as locked by the same locking device, to mark the illumination setting as unlocked, wherein the controller is configured to modify the illumination setting according to that control command from the locking device.

In embodiments, the system is configured to automatically mark the illumination setting as unlocked in response to expiration of an unlock duration from a time of it being marked as locked.

According to a second aspect disclosed herein, there is provided a locking device for a lighting system comprising: a user interface; a data interface for communicating with the lighting system; a control command module configured to generate at the data interface, in response to at least one input from a user at the user interface, a control command for applying at least one illumination setting to at least one illumination source of the lighting system; and a lock command module configured to generate at the data interface a lock command pertaining to the illumination setting for marking the illumination setting as locked.

In embodiments, the user interface comprises a plurality of user interface elements, the control command is generated in response to actuation of one of the user interface elements, and the lock command is generated in response to immediate actuation of the same user interface element.

In embodiments, the locking device is configured to generate at the data interface a command for unlocking the applied illumination setting in response to subsequent actuation of the user interface element.

According to a third aspect disclosed herein, there is provided a method of controlling an illumination source of a lighting system, the method comprising implementing by a controller of the lighting system the following steps: applying an illumination setting to the illumination source; receiving a control command pertaining to the applied illumination setting; in response to the control command, accessing electronic storage to determine whether the illumination setting is marked as locked therein; and modifying the applied illumination setting according the received control command unless the illumination setting is marked as locked in the electronic storage when the control command is received, wherein the illumination setting is not modified in response to that control command in that event.

According to a fourth aspect disclosed herein, there is provided a controller for use in controlling an illumination source, the controller being configured to implement the method according to the third aspect disclosed herein.

According to a fifth aspect disclosed herein, there is provided a computer program product comprising code stored on a computer readable storage medium and configured when executed to implement the method according to the first aspect disclosed herein.

In some cases, the locking device itself may include logic to recognize the user's intention to lock the setting, referred to herein as a locking command module. For example, the locking device itself may recognize the twice-actuation of the UI element as an instruction from the user to lock the setting and notify the system of this via the lock command. Alternatively the locking device may simply inform the system each time the UI element is actuated, and the user's intention to lock the system is recognized elsewhere, e.g. at the controller or some other component of the system. In other words, the locking device itself may recognize a locking action at its UI (e.g. two presses of the same button) and communicate the recognized lock action to the system in the lock command or the locking action may be recognized elsewhere in the system (e.g. at the controller or another component).

As such, the setting can be marked as locked in the electronic storage by the locking device, the controller, or some other component of the system.

Preferably, the user can unlock the setting by actuating the same UI element a third time, in response to which the locking device generates an unlock command pertaining to the illumination setting, in response to which the system marks the setting as unlocked. For example, the UI elements may be (physical) buttons, e.g. the locking device may be a dedicated lighting system control unit.

In general, any of the functions recited above as being implemented by the lighting system can be implemented by the locking device, the controller, or another component of the lighting system.

For example, another aspect of the invention is directed to a controller for an illumination source, the controller configured to apply at least one illumination setting to at least one illumination source, receive a lock command pertaining to the applied illumination setting, and mark the illumination setting as locked in electronic storage in response. The controller is also configured to receive a control command pertaining to the applied illumination setting and modify the applied illumination setting according to that control command, unless the illumination setting is marked as locked when it is received, wherein the illumination setting is not modified in response to that control command in that event.

In some embodiments, the controller may apply the illumination setting in response to an initial control command from a locking device, and only mark the setting(s) e.g. as locked if the lock command is received from the same locking device within a predetermined duration of the initial command.

For example, pressing a button (or other UI element) on the locking device may instigate the initial control command (e.g. to render a lighting scene) to apply the lighting scene, and pressing the same button again within the predetermined duration may instigate the lock command. Pressing the same button (at any time) may unlock the setting (e.g. scene) again, by instigating an unlock command from the locking device.

BRIEF DESCRIPTION OF THE DRAWINGS

To assist understanding of the present disclosure and to show how embodiments may be put into effect, reference is made by way of example to the accompanying drawings in which.

DETAILED DESCRIPTION OF EMBODIMENTS

The present invention relates to a connected lighting system that can be controlled from a plurality of sources. All devices that can interface with the lighting system can change the light settings. These may be: user triggered such via a switch or app on a user device; automated such as timed schedules; or triggered from out-of-home state changes such as lighting scene updates linked to a football team scoring or other external data.

The present invention allows a user to "lock" that content (state/dynamics) on some or all of the luminaires by performing a dedicated user action. For example, the dedicated user action may be a specific input pattern (e.g. a triple tap of a switch), or the dedicated user action may be the user twice performing a given action such as enacting a specific scene. In the latter case, the first command activates the scene by applying one or more illumination settings to render the scene, and the second command locks it from any further changes. In some implementations, this may be conditional on a duration between the first and second commands being less than a threshold (e.g. one or a few seconds). Preferably, a third command (after some timeout) then unlocks the luminaires again so that they will respond to other input again.

Figure 1:
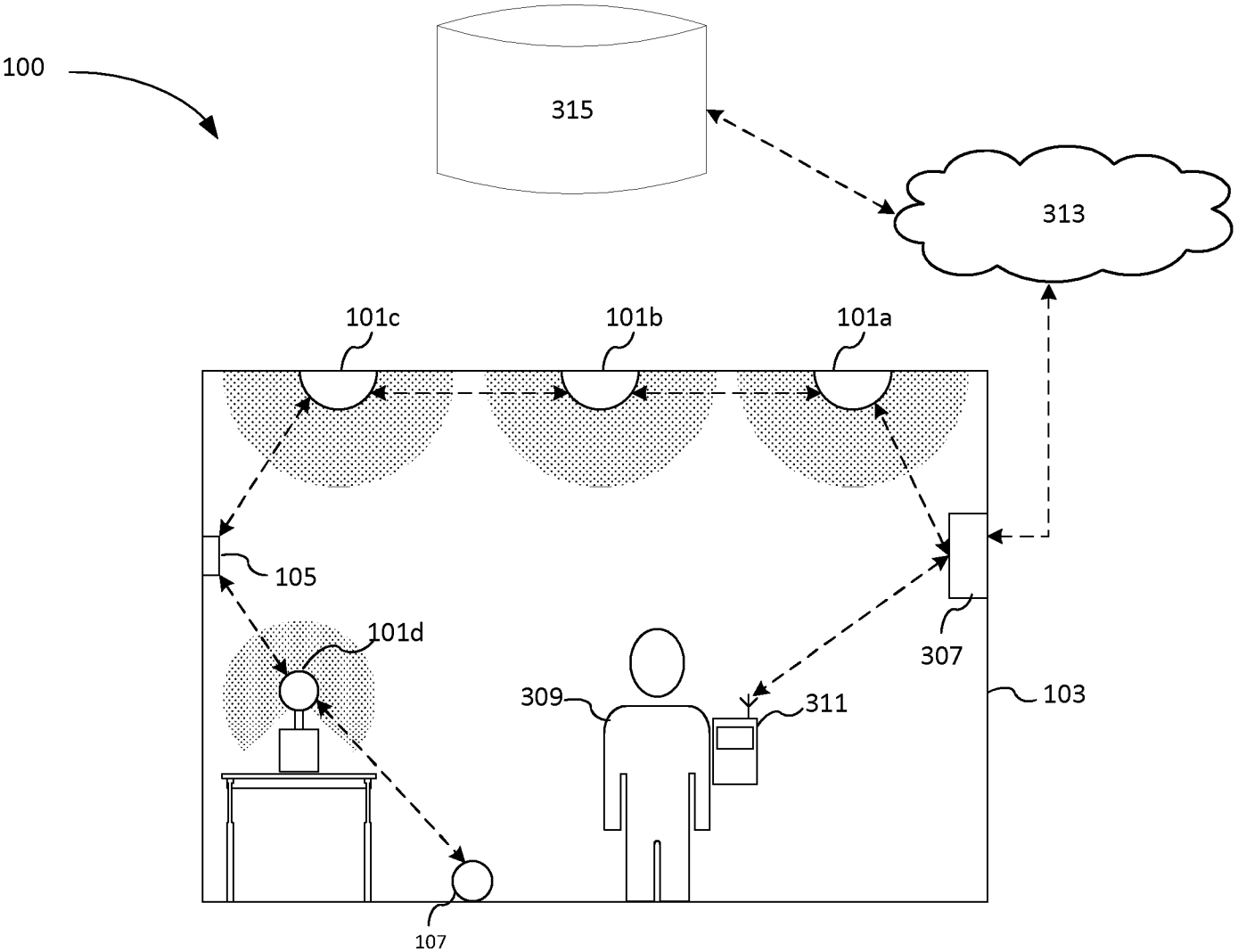
FIG. 1 shows a system according to embodiments of the present invention.

FIG. 1 shows a lighting system 100 according to embodiments of the present invention. An environment 103 contains a plurality of luminaires 101*a-d* and a switch 105. Luminaires 101*a-c* are ceiling type luminaires designed to provide illumination in the environment 103 from above. Luminaire 101*d* is a free-standing lamp type luminaire placed on a table designed to provide illumination in the environment 103 from a lower position than the ceiling type luminaires 101*a-c*. Each of the luminaires 101*a-d* may be any suitable type of luminaire such as an incandescent light, a fluorescent light, an LED lighting device etc. The plurality of luminaires 101*a-d* may comprise more than one type of luminaire, or each luminaire 101*a-d* may be of the same type. Each of the luminaires comprises at least one illumination source (401, FIG. 2).

The switch 105 is shown in FIG. 1 as a wall-mounted switch and may be any suitable type of switch allowing user input to control the plurality of luminaires 101*a-d*. For example, the switch 105 may be a simple on-off controller switch or may allow for more complex control such as dimming and possibly even control of individual lighting characteristics such as hue and saturation. The switch 105 may also be a portable switch (portable remote control) capable of being moved from one environment to another. The term "switch" is used herein to refer to any control device allowing a user to input commands into the lighting system.

The plurality of luminaires 101*a-d*, the switch 105, along with a lighting bridge 307 form a connected lighting network. That is, they are all interconnected by wired and/or wireless connections, indicated by dotted lines in FIG. 1. In particular, FIG. 1 shows "chaining" connections such as may be implemented in a ZigBee lighting network, wherein it is not necessary for each device to be directly connected to each other device. Instead, devices are able to relay communication signals which allows for, for example, luminaire 101*c* to communicate with the lighting bridge 307 by relaying data through luminaires 101*b* and 101*a* to lighting bridge 307. However, it is not excluded that other network topologies may be employed. For example, a "hub-and-spoke" topology may be used in which each device is directly connected (e.g. wirelessly) to the lighting bridge 307 and not to any other devices in the network.

As another example, each luminaire in the network may be configured according to one communication protocol, such as ZigBee, and the switches may be configured according to another communication protocol, such as WiFi. Hence, it is appreciated that the luminaires may communicate with each other and the lighting bridge 307 without relaying data through a switch as shown in FIG. 1, and the switch 105 may communicate directly with the lighting bridge 307. In any case, it is understood that the lighting bridge 307 is able to communicate, by whatever appropriate means, with each other device in the lighting network.

Note that connected lighting systems exist which do not comprise a lighting bridge as described above. In these cases lighting control commands may be provided directly to each luminaire (i.e. instead of via a bridge). What is important is that a connected lighting system comprises luminaires which can communicate with a control device (e.g. a user device) and therefore be controlled. The luminaires may or may not be able to communicate with each other.

Lighting bridge 307 is arranged at least to receive input (e.g. from switch 105) and to send lighting control commands to luminaires 101*a-d*.

FIG. 1 also shows a user 309 and user device 311 such as a smart phone. The user device 311 is operatively coupled to the lighting bridge 307 by a wired or wireless connection (e.g. WiFi or ZigBee) and hence forms part of the lighting network. User 309 can provide user input to the lighting bridge 307 via the user device 311 using, for example, a graphical user interface of the user device 311. The lighting bridge 307 then interprets the user input and sends control commands to the luminaires 101*a-d* accordingly. As mentioned above, the user device 311 generally allows for more complex control than the switch 105. For example, the user 309 may use the user device 311 to control an individual luminaire. In general it is desirable that the switch to control the luminaires in the same environment as the switch itself, i.e. in FIG. 1 switch 105 controls only luminaires 101*a-d*, but the user device 311 may control any luminaire at all within the lighting network. For example, the user 309 may use the user device 311 to control a luminaire in another environment, such as controlling a luminaire in a different room other than the room in which the user 309 and user device 311 are currently. This is particularly advantageous because the user device 311 is generally more portable than a switch (particularly a wall-mounted switch), and hence may be used at different physical locations. The user device 311 may be used to control the plurality of luminaires 101*a-d* to render a lighting scene, e.g. by the user 309 selecting the lighting scene and desired luminaires using a GUI of the user device 311.

As illustrated in FIG. 1, lighting bridge 307 may also be provided with a wide area network (WAN) connection such as a connection to the internet 313. This connection, as known in the art, allows the lighting bridge 307 to connect to external data and services such as memory 315. Note that the wireless connection between user device 311 and the lighting bridge 307 is shown in FIG. 1 as a direct connection, but it is understood that the user device 311 may also connect to the lighting bridge 307 via the Internet 313.

A sensor 107 is present within the environment 103 and is arranged to detect the presence of users within the environment 103. The sensor 107 is part of the lighting network in that it is arranged to communicate with the network via a wired or wireless connection. That is, the sensor 107 is arranged to at least be operatively coupled to the lighting bridge 307.

Although shown in FIG. 1 as a single entity, it is understood that any suitable sensor or plurality of sensors may be used to provide the functionality ascribed herein to the sensor 107. For example, the sensor 107 may comprise a sensor arranged to detect the presence of users directly, such as a near infra-red sensor, a camera, an ultrasonic sensor, or other sensors known in the art. As a further example, the sensor 107 may comprise a sensor arranged to detect the presence of users indirectly, e.g. by detecting the presence and/or location of a user device 311 carried by the user. In this case, the sensor 107 may comprise a plurality of signaling beacons arranged to communicate with the user device 311 to determine its location, as known in the art.

In operation, the luminaires 101*a-d* are rendering a lighting scene. The user 309 is enjoying the lighting scene and wishes it to continue. However, without action by the user 309, the lighting scene may change. For example, a second user may control the luminaires 101*a-d* to render a different lighting scene, or a different lighting scene may be enacted in response to a timer or other input etc. Hence, the user 309 wishes to lock the lighting scene. The present invention allows the user 309 to do this simply and efficiently. There are two main ways in which the user 309 may lock the lighting system 100:

- Activating the same lighting scene twice within a predetermined time window; or
- Dedicated user action to lock the scene, such as action of a dedicated lock button, or a specified action of an existing button e.g. a triple tap of switch 105.

The system may be configured to recognize one or both of the above user actions. In any case, user 309 may input the user action via any suitable means such as switch 105 or user device 311.

As described above, the lighting system comprises devices other than the luminaires 101*a-d*, e.g. the switch 105. Hence, it is preferable for the "lock" behavior described herein to cover all the input/output devices of the system, generally called "actuators". That is, when the scene is locked not only are the luminaires locked but also the switches and other input devices. This can be selective—for example it may be preferable to lock only devices from, say, sensors or automated routines, i.e. to block automatically generated control commands, but not, say, light switches, i.e. to execute all user-generated (i.e. manual) commands irrespective of locking status (i.e. irrespective of whether the relevant setting(s) are marked as locked). A locked luminaire means a luminaire having at least one locked illumination setting. A locked control device means a control device whose control commands are ignored in so far as they pertain to locked settings. The term "actuator" also covers other devices within the system which may create a perceivable effect for the user. For example, an actuator controlling the position of curtains covering a window. In this case, the actuator (and hence the position of the curtains, e.g. closed or open) can be locked as well. This is particularly advantageous for example if the user 309 wishes to watch a movie during the day and sets the luminaires 101*a-d* to render a "movie" scene comprising minimal lighting, and sets the curtains to be closed to block external natural light. The movie scene and the curtain positon would then both be locked.

The type can be identified by identity or source of the command e.g. sensor/routine for automatically-generated commands vs switch/manual controller for user-generated commands.

Preferably, once the lighting scene is frozen, a timeout period (e.g. 30 seconds) is entered so the user 309 does not accidentally unlock the system directly again. This is particularly advantageous if the user input for a locking command is the same as the user input for an unlocked command (i.e. a toggle switch). The timeout period may only apply to the input devices (e.g. switch 105). In this case, all actuators are initially locked (and hence the input devices do not have any effect on the luminaires) but after the timeout period the input devices are no longer locked and the luminaires continue to render the locked scene until a further input is received from, e.g. switch 105 or user device 311.

Actuators are locked by storing to memory 315 an indication of which actuators are locked. Hence, when the system 100 receives user input, it first checks memory 315 to see if the user input pertains to a locked actuator and, if so, ignores the user input.

Figure 2:
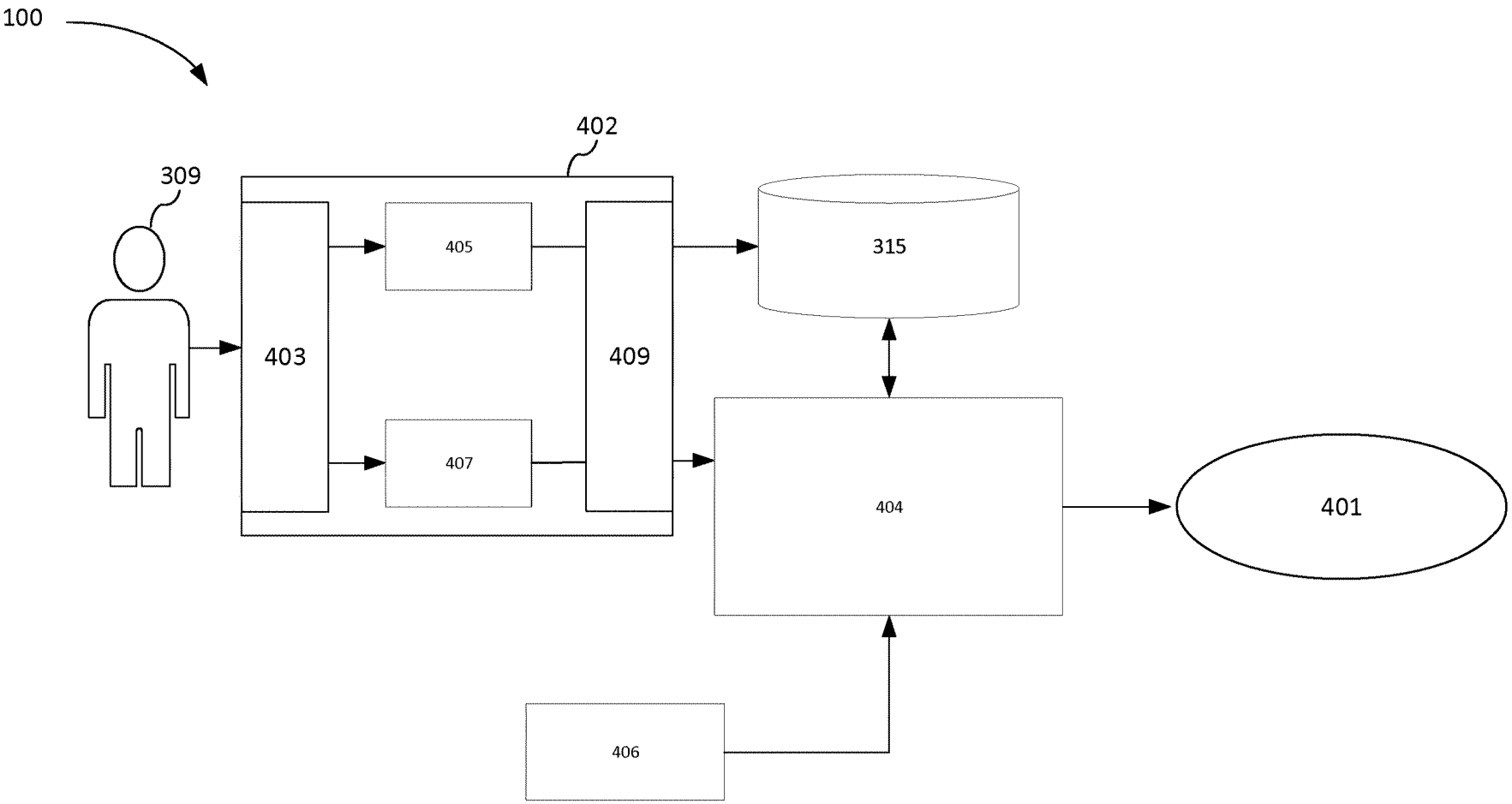
FIG. 2 is a functional block diagram of a controller according to embodiments of the present invention.

FIG. 2 shows a block diagram of the lighting system (100) which is shown to comprise a locking device 402, a lighting controller 404, electronic storage in the form of a memory 315, at least one illumination source 401, and at least one additional control device 406. The lighting controller 404 represents certain control functionality within the lighting system 100 relating to the processing of control commands based on locking status. This is described below, and can be implemented at a central control device, e.g. the bridge 307, or locally at the luminaires themselves, or even at the user device 311 or switch 105. Alternatively, the functionality can be distributed across two or more of these devices, e.g. part may be implemented at the bridge 107 and part at one or more of the luminaires. The controller 404 can be implemented in software, i.e. as code executed on a processor or processors of the relevant device or devices, dedicated hardware, or any combination thereof. The locking device 402 may be for example the switch 105 or the user device 311 of FIG. 1.

The locking device 402 comprises a user interface 403, a lock command module 405, a control command module 407, and a data interface 409. The user interface is arranged to receive user input from a user 309 and provide an indication of the user input to both the lock command module 405 and the control command module 407. For example, the user interface 403 may comprise a switch, a slider, a graphical user interface etc. and thereby enable the user 309 to provide user input to the control system 400. The control and lock command modules 405, 407 can for example be code modules executed on a processor(s) of the locking device, dedicated hardware of the locking device 402 or a combination of both.

The user input may be one or both of two broad types. Firstly, the user input may be of a control type intended to alter the output of the luminaires 101*a-d*, e.g. to render a lighting scene. Secondly, the user input may be of a lock command type intended to lock one or more of the luminaires 101*a-d* as described more fully later.

Control command module 407 receives an indication of user input from the user 309 via the user interface 403 and is operable to determine when the user input is of a control command type. If the user input is of a control command type, the control command module 407 generates a control command which it then provides to data interface 409 for transmission to lighting controller 404. The lighting controller 404 can then interpret the control command and control the illumination sources 401 accordingly. This may comprise controlling at least one of the luminaires 101*a-d* to change its rendered lighting effect (e.g. to change hue, brightness, and/or saturation).

Similar control commands can be received by the lighting controller 404 from control device 406. Here, control device 406 represents any other device capable of providing input to the lighting controller 404 which would cause the lighting controller 404 to alter the illumination provided by the illumination sources 401. For example, the control device 406 may be another user device other than user device 311 which has access to the system. The controller device 406 may be a device other than a user device, for example sensor 107 which can provide sensor data to the lighting controller 404 which causes it to change the illumination (e.g. to increase the brightness of the luminaires 101*a-d* in response to the sensor 107 detecting the presence of the user 309 within the environment 103, as is known in the art) or a device running an automated routine that generates control commands automatically. What is important is that the control device 406 is able to instruct the lighting controller 404 to control the illumination sources 401. Hence, the control device 406 may be capable of altering the illumination in a way which is not desired by user 309.

That is, the lock command module constitutes logic at the locking device 307 itself to recognize when a user wishes to lock settings and to inform the lighting system 100 accordingly (alternatively, this determination can be made elsewhere in the system 100—see below).

The user interface 403 also provides an indication of the user input to lock command module 405. The lock command module 405 is operable to determine when the user input is of a lock command type. If the user input is of a lock command type, the lock command module 405 generates, based on the user input, a lock command indicating a set of at least one of the luminaires 101*a-d* which is to be locked. The lock command module 405 then provides the generated lock command to data interface 409 for transmission to memory 315. Note that although shown directly in FIG. 2, it is appreciated that lock command module 405 generally only causes the set of luminaires to be stored in memory 315, which may not require direct transmission from the data interface 409 to the memory 315. For example, the lock command module 405 may transmit the lock command to the controller 404 which then performs the steps of storing the set of luminaires in memory 315. Either way, a list or set of luminaires which are part of a locked set is stored in memory 315, to which the lighting controller 404 has access, as described below. This means that user 309 is able to specify a list of luminaires which are to be considered "locked" by the system.

The user input may also be to unlock one or more of the luminaires 101*a-d*. In this case, the indication of the user input received by the lock command module 405 causes the lock command module to generate an unlock command for transmission to the memory 315 (again, not necessarily directly) which causes those one or more of the luminaires 101*a-d* to be removed from the locked set. In this sense, the set of luminaires which is stored on memory 315 may comprise a complete list of locked luminaire, in which case the luminaires may be added to and removed from the set, or the set may comprise all the luminaires and a respective indication of whether or not each luminaire is locked. In either case, the stored set may be considered a "blacklist" of luminaires.

As mentioned above, the user 309 is able to control the illumination sources by providing input to the system via user interface 403, and the user 309 is also able to lock one or more of the luminaires 101*a-d*.

Now, when a further command is received by the lighting controller 404 (from either control command module 407 via data interface 409, or from control device 406), the lighting controller 404 first accesses memory 315 to determine whether the received control command is attempting to control a locked luminaire or a non-locked luminaire. That is, the controller 404 accesses memory 315 and determines whether or not the luminaire to which the received control command pertains is part of the locked set stored in memory 315 or not.

If the control command pertains to a non-locked luminaire (a luminaire which is not part of the locked set stored in memory 315), then the lighting controller 404 controls the luminaire(s) 101*a-d* in accordance with the control command, as usual.

If the control command pertains to a locked luminaire (a luminaire which is part of the locked set stored in memory 315), then the lighting controller 404 must perform additional steps in order to determine whether or not to permit the control command (i.e. to control the luminaires 101*a-d* in accordance with the control command). These steps are described later with reference to FIGS. 3A, 3B and 4.

Figure 2A:
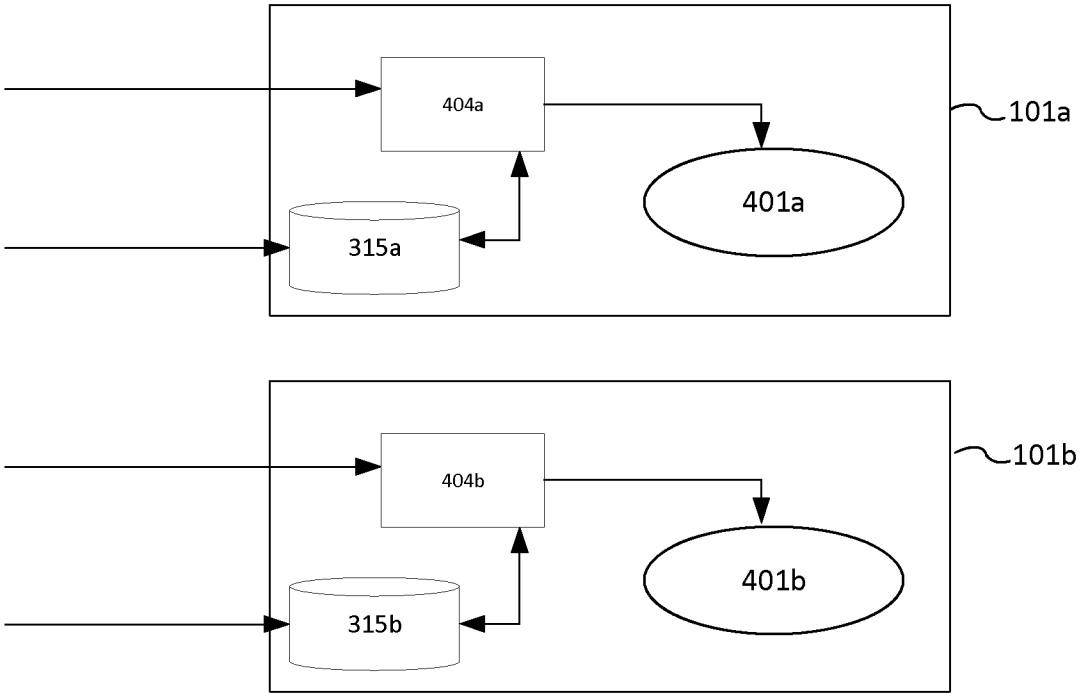
FIGS. 2A and 2B are example implementations of the controller.
Figure 2B:
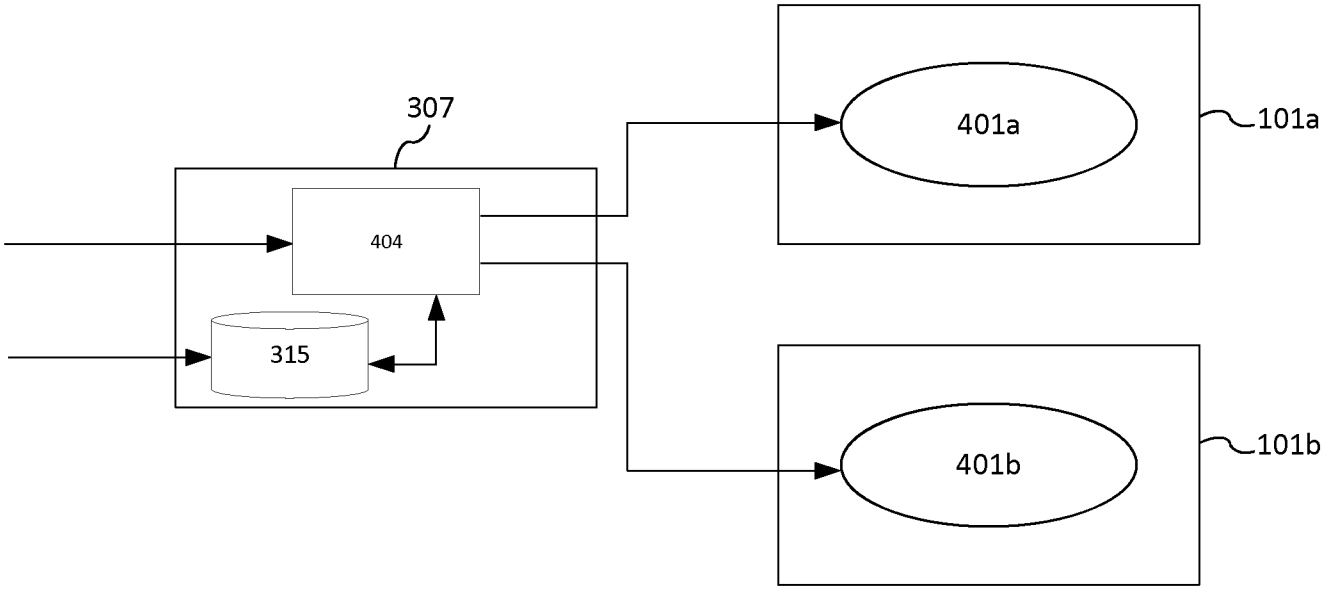

FIGS. 2A and 2B illustrate example implementations of the control system 400.

FIG. 2A shows a luminaire-centric approach. In this example, only two luminaires 101*a* and 101*b* are shown but it is appreciated that any number of luminaires may be present. Each luminaire comprises a respective illumination source 401, lighting controller 404, and memory 315 (though the memory may be external to the luminaire itself). In FIG. 2A, luminaire 101*a* comprises a lighting controller 404*a*, a memory 315*a*, and an illumination source 401*a*. And luminaire 101*b* comprises a lighting controller 404*b*, a memory 315*b*, and an illumination source 401*b*. The lock command generated by the lock command module 405 and the control command generated by the control command module 407 are provided to each luminaire. That is, the lock command is received by and stored in both memory 315*a* and memory 315*b* and the control command is received by both lighting controller 404*a* and 404*b*.

Also shown in FIG. 2, by dotted arrows, is an alternative for the lock command. In these embodiments, the lock command generated by the lock command module 405 is transmitted to the lighting controller 404 rather than the memory 315 as described above. The lighting controller 404 then performs the steps of causing the memory 315 to store a set of locked luminaires. In other embodiments, some functionality of the lock command module 405 may be implemented in the lighting controller 404. This is particularly advantageous in embodiments where, for example, a control command to render a lighting scene which is already being rendered is used as a lock command. Hence, the controller 404 is able to determine that the received control command is to render a lighting scene which is already being rendered and therefore generate the lock command itself (rather than receive it from an external lock command module 405).

Some known system architectures only transmit control commands to the luminaire(s) to which they are intended. However, other architectures (such as DALI) transmit all control commands to all luminaires, and each luminaire must first determine that a control command is addressed to it. In either case, the luminaire-centric approach of FIG. 2A, comprises the respective lighting controller 404*a-b* of each luminaire 101*a-b* accessing their respective memory 315*a-b* to determine if they themselves are locked, which is a special case of the lighting controller 404 of FIG. 2 accesses memory 315 to determine if the received control command pertains to one or more locked luminaires.

FIG. 2B shows a centralized approach. In this case, there is a single instance of the lighting controller 404 which may be implemented in the lighting bridge 307 as shown in FIG. 2B (or may be implemented in other elements of the lighting system 100 such as the user device 311, or the switch 105, for example).

The lock command is received at the memory 315 which is shown in FIG. 2A as a single centralized memory unit of the lighting bridge 307 but it is appreciated that any memory which is accessible by the lighting controller 404 could be used. For example, one or more memory units external to the lighting bridge 307 which can be access by a wired or wireless network (e.g. a memory on the user device 311, switch 105, or one or more of the luminaires 101*a-d*). In any case, the lock command is received and stored at the memory 315 as described above.

The control command is received by the lighting controller 404 which, as in the embodiment of FIG. 2A, causes the lighting controller 404 to access memory 315 to determine whether the received control command pertains to one or more locked luminaires. If the control command is intended to control luminaires which are not locked, then the controller 404 controls those luminaires in accordance with the control command. This comprises controlling one or more of the luminaires 101*a-b* to alter the lighting effect rendered by their respective illumination source 401*a-b*. If this is not the case, the controller 404 must perform additional steps, as described in more detail below.

Figure 3A:
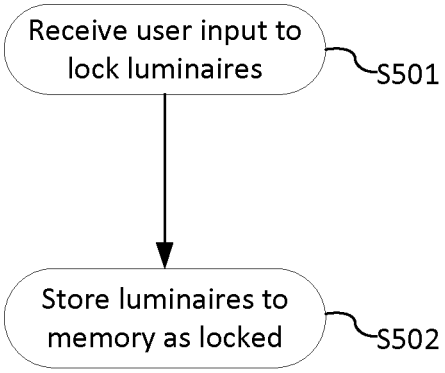
FIGS. 3A and 3B are a methods performed by the controller in accordance with embodiments of the present invention.
Figure 3B:
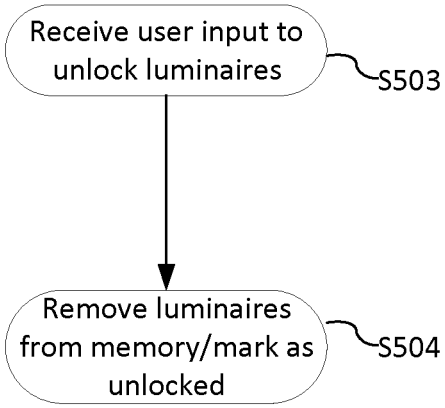

FIGS. 3A and 3B are a flow diagrams of a methods implemented by the controller 400 in accordance with embodiments of the present invention.

In FIG. 3A, a lighting scene is being rendered by the luminaires 101*a-d* which the user 309 wishes to lock. To do so, the user 309 provides user input to the locking device 402 via user interface 403 at step S501 which causes lock command module 405 to generate a lock command which triggers memory 315 to store a set of locked luminaires 4. This may comprise marking the luminaires of said set as locked in memory 315, and may comprise adding the luminaire to a stored set of locked luminaires.

The user input may be a dedicated lock input. For example, the lighting application running on the user device 311 may allow the user 309 to select a "lock" button which explicitly instructs the locking device 402 to lock the system 100. Such a dedicated "lock button" may also be implemented on switch 105.

The user input may be a specific, predetermined, combination or pattern of other inputs. For example, a triple tap of a button on the user device 311 or switch 105. In this case, the button (which may usually be used to control the scene, for example) is provided with additional functionality in that it is used to lock the system 100. Other patterns include different combinations or buttons and durations thereof. For example, pressing both an "on" button and an "off" button at the same time, preferably for more than a threshold time such as 5 seconds.

The user input may be a command to render the same scene as the scene already being rendered by the luminaires 101*a-d*. In this case, the user 309 can lock the system 100 by selecting the scene on his user device 311 (or switch 105). The controller 404 is then able to determine that the scene selected by the user is already being rendered by the luminaires and thus interpret this input as a lock command. This is particularly advantageous as it is easy for the user 309 to implement. A further command to render the same scene may be used to unlock the system. The user input may be a single press of a button (e.g. on switch 105 or user device 311). The first press triggers a control command to render the scene, a second press (within a threshold time) triggers a lock command (e.g. for all luminaires, or at least the luminaires in the environment rendering the scene), and then a third press at a later time triggers the system to unlock. For example, the user 309 may:

1) Press a light switch one triggers the associated scene;
2) Pressing it again (within a threshold time, e.g. 5 seconds) locks the scene (i.e. any further input, e.g. from sensors and routines, is ignored);
3) Pressing it again (at any time) unlocks the scene.

At step S502 the set of locked luminaire is stored to memory 315 and hence those luminaires are locked.

As mentioned above in relation to FIG. 2A, this 'locked' status can be implemented in a distributed manner, i.e. each individual actuator is locked. To do this, the locked status is stored in the actuator and all other network nodes can still send commands to it, but it will simply refuse to execute that command. That actuator can provide some (multi-modal) indication to the user that it has rejected the command (not executed that command). For example, if the actuator is a luminaire it might blink, or for a general actuator it may emit an auditory signal, or cause an icon to be displayed on a user interface such as a graphical user interface of the user device 311.

Alternatively, as described in relation to FIG. 2B, the 'locked' status can implemented centrally, i.e. by a central controller 404 implements. To do this, the controller 404 simply ignore signals to and/or from the locked actuators. That is, when an actuator is locked the controller 404 will not send any commands to it. In this centralized case, the system also has to be unlocked centrally (on the controller 404) again.

One particular advantage of these embodiments (as opposed to the distributed method described above) is that there is a central administration for the user 309 to see which actuators are locked. For example the controller 404 may provide an indication of which actuators are locked to the user device 311 which can be displayed to the user 309 via user interface of the user device 311. Additionally, the centralized method generally reduced network traffic requirements, as no message have to be sent to each actuator. However, any direct communication to an actuator will still be able to control that actuator, and hence the distributed method described above has the advantage that a (potentially malicious) user cannot circumvent the lock in the same way that one might in the centralized approach.

A hybrid approach is also possible in which some of the actuators are locked by a central controller 404 (as in the centralized approach) and other actuators are locked by their own local controller 404*a-b* (as in the distributed approach). Additionally, it is not excluded that one or more of the actuators may be locked via both the central controller 404 and a local controller 404*a-b*.

A locked status does not imply that only static lighting scenes can be locked. Dynamic scenes may also be locked. In that case the actuator and transmitter will agree on a method of communication to identify commands from that source ("locking protocol"). Any command that does not fit this protocol is excluded and not handled. This enables a user to lock a 'dynamic scene'. The scene will still play and the light may change, but only as part of the dynamic scene. Generally, the locking protocol is a set of rules, e.g. predetermined or agreed dynamically, say, between the locking device and controller, which dictates which types of commands will be ignored for a locked setting.

A control device having a type such that its control commands are ignored for a locked illumination setting is locked (in the above sense) to the sense that if it is used to control that setting.

Preferably, the system 100 can only be locked through user-generated commands. This is to prevent that an automatic script accidentally or erroneously sends two commands shortly after each other and thereby locks the complete system. Furthermore, this also has the advantage that only intentional user commands lock the system.

As shown in FIG. 3B, to unlock the system the user provides user input to unlock the luminaires via user interface 403. This is recognized by the lock command module 405 as an unlock command. Responsive to this, the lock command module 405 causes the list of locked luminaires stored in memory 315 to be updated to not list the unlocked luminaires as locked. This can be accomplished in an analogous manner to that described above with reference to locking, and hence is not repeated here. In any case, the system is unlocked at step S504 when the luminaires are either removed from memory 315 or marked in memory 316 as not locked. As mentioned above, the lock module 405 preferably only accepts an unlock command from the user 309 and performs the above steps leading to unlocking after a predetermined time interval, or timeout period, after the system was initially locked.

The unlock command may be a dedicated unlock command. For example, the lighting application running on the user device 311 may allow the user 309 to select an "unlock" button which explicitly instructs the controller 400 to unlock the system 100. Such a dedicated "unlock button" may also be implemented on switch 105. The unlock button may be the same physical button as the lock button described above.

The unlock command may be a specific, predetermined, combination or pattern of other inputs. For example, a triple tap of a button on the user device 311 or switch 105. In this case, the button (which may usually be used to control the scene, for example) is provided with additional functionality in that it is used to unlock the system 100. As with the lock pattern, other patterns include different combinations or buttons and durations thereof.

The unlock command may be a command to render the same scene as the scene already being rendered by the luminaires 101*a-d*. In this case, the user 309 can unlock the system 100 by selecting the scene on his user device 311 (or switch 105). The controller 404 is then able to determine that the scene selected by the user is the same as the scene already being rendered by the locked luminaires and thus interpret this input as an unlock command.

Additionally, the unlock command may be implicit (or at least less explicit than the examples given above). For example, any locked content should be lost when the lights are 'reset' (by a hard power-off). Depending on where the locking mechanism is implemented, either the actuators reset this lock (remove themselves from the blacklist stored in memory 315) when they are rebooted, or the actuators could inform the controller 404 to release the lock (to remove them from the blacklist stored in memory 315) when they reboot. For a user it is important that a locked system is released automatically.

Especially in the case where the user locks a lighting scene for a longer period of time, or locks it accidentally, he may not be aware that settings are locked. Hence, it is preferable that the system is unlocked (as per step S504) automatically after a period of time (e.g. 6 hours), at a specific time (e.g. every night at 02:00), when all users have left the home (as may be detected by sensor 107, as known in the art) or when an 'all off' command is executed in the system.

Figure 4:
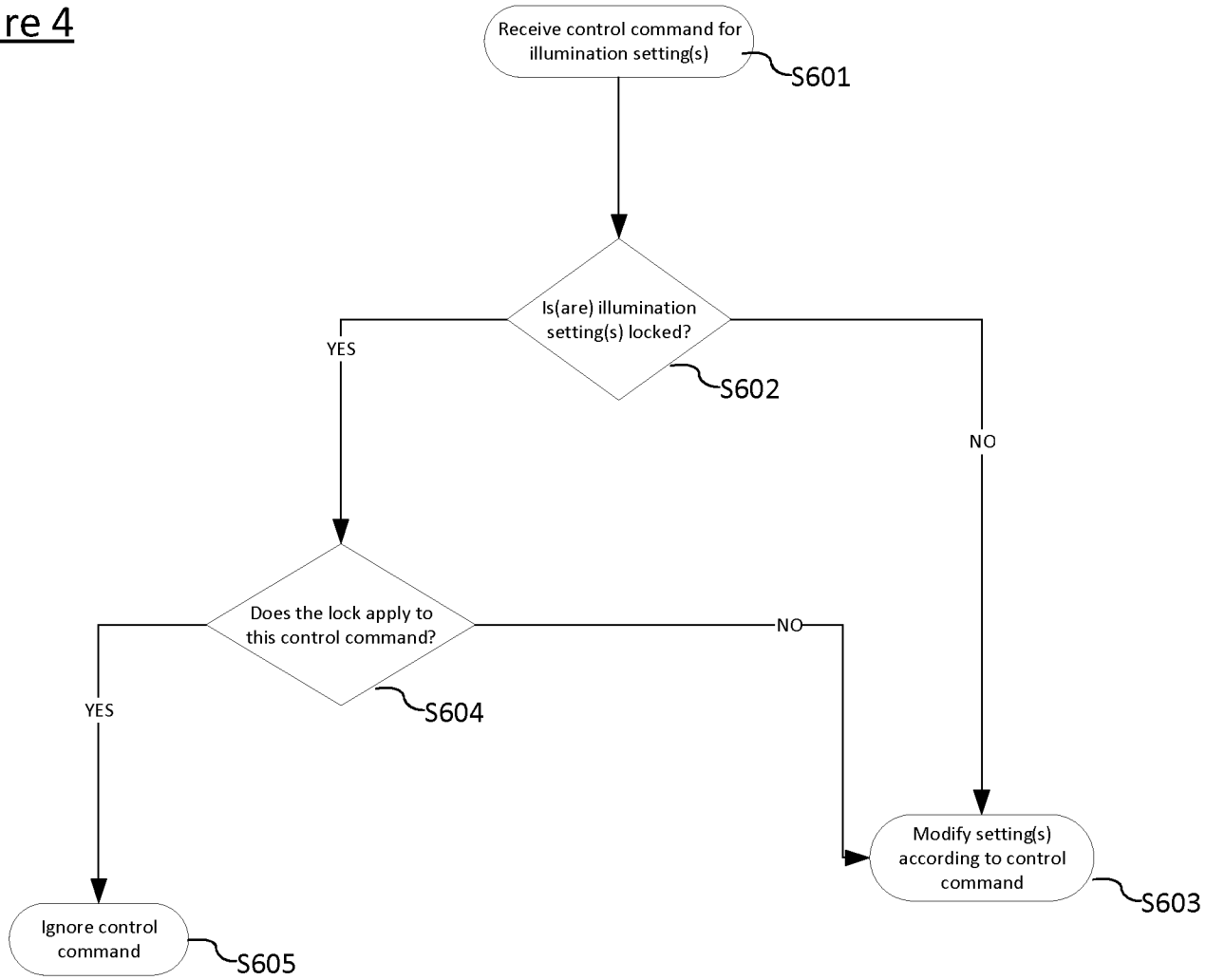
FIG. 4 is a flowchart illustrating the behavior of the controller.

FIG. 4 summarizes the above-mentioned conditions in a flow chart. At step S601, a control command is received by the controller 404. The control command specifies at least one luminaire and at least one new lighting setting or change to an existing lighting setting. It is understood that the lighting controller 404 is capable of interpreting the control command in order to control the luminaire(s) appropriately. In the present invention however, the controller 404 first performs some steps to determine whether or not to act on the received control command.

At step S602, the controller 404 determines if the control command pertains to a received illumination setting. This comprises accessing memory 315 to determine whether the control command pertains to a luminaire which is a member of the locked set stored therein. If the control command does not pertain to a locked luminaire, then the controller 404 proceeds to step S603 and controls the luminaire(s) in accordance with the control command, i.e. as it would have done in a conventional lighting system.

If the control command does pertain to a locked luminaire, the controller 404 proceeds to step S604 and determines whether or not the lock applies to the received control command. That is, there may be exceptions to the lock for particular commands. These exceptions include the command type, the command source, and the command priority.

For the command type exception, the type of command may be taken into consideration by the controller 404. For example, an "emergency" command may be always considered not-locked by the controller 404 so that the controller 404 always controls the luminaires 101*a-d* in accordance with the emergency command, even if they are members of the locked set in memory 315. Indeed, for some types of command like the emergency command type, the controller 315 may not check the memory 315 at all.

Some control commands, e.g. those originating from the locking device 402 itself, may automatically cause the settings to which they pertain to be unlocked at this stage. Other types of control command may be executed, i.e. to modify even a locked setting, but not unlock the setting for future commands.

For the priorities exception, every behavior, device, and/or user has a 'priority level'. Then, for example, if a user of a given priority level (e.g. priority level B) locks the system, only users of the same priority level or higher (priority level B or higher) can unlock the system.

A user may also input a specific lock command which specifies a priority level. For example, if a user pressed switch 105 X amount of times, only behaviors, devices, users with priority level greater than or equal to X can overrule the locked setting. With 2 levels this is the simple case: 'can override' vs 'cannot override' locked scenes.

For the command source exception, some controlling devices may always control the lights, for example the smart phone of the user. This could also be created by having a hierarchy of control commands with different priorities, whereby lower priority control commands can never override settings of higher control commands until the relevant settings are unlocked. The priority of a given control command can be determined based on either the type of command itself or the device which was the source of the command. In the former case, an example is that commands to change the brightnesses of the luminaires may be permitted, but commands to change the colors of the luminaires may be forbidden. In the latter case, some devices may be allowed control and some not, regardless of the type of control command. For example, there may be multiple user devices present but only one user device is permitted to control the luminaires. In this case the permitted device may be considered a "master" device and the memory 315 may store an indication of which device is the master device (e.g. by an ID of the device) or the master device could provide If the control command does not fall under one of the exceptions, then the lock applies and the controller 404 proceeds to step S605 and ignored the control command.

If the control command does fall under one of the exceptions, then the lock does not apply and the controller 404 proceeds to step S603, as above.

The following is an example use case intended to make the advantages of the present invention clear. In this scenario, a user wants to watch a movie in his living room, where he also has a daily 'go to sleep' routine and a sensor.

- The user recalls a "movie scene" via switch 105 with a first press.
- The user 'locks' the content from the "movie scene" with a second press on switch 105.
- All luminaires that are part of this scene will only respond to commands when they are unlocked again.
- Optionally: only a command (including setting another scene or switching the lights off) from that same switch 105 will unlock the content again.
- A 'go to sleep' routine triggers at 23.00 but does not change the light settings, because they are locked by the previous "double action" on the switch 105.
- When the user goes to the bathroom and the motion sensor (in the living room) detects motion, the lights do not change, because they are still locked by the switch 105.
- After the movie the user selects the 'socialize' scene on the switch 105 with a single press. The content is now on 'socialize' in unlocked state which means it can be changed by automatic behavior. Alternatively, he can press the button for the 'movie' scene once to unlock, which releases the lock and allows all other devices and automated scripts to control the lights again.

It will be appreciated that the above embodiments have been described only by way of example. Other variations to the disclosed embodiments can be understood and effected by those skilled in the art in practicing the claimed invention, from a study of the drawings, the disclosure, and the appended claims.

For example, the locked actuators could identify themselves to the user 309 in response to an "identify" command received from, e.g. the user device 311. This would cause the locked actuators to identify themselves, e.g. if the actuator is a luminaire it might blink, or for a general actuator it may emit an auditory signal, or cause an icon to be displayed on a user interface such as a graphical user interface of the user device 311. A further extension is for each actuator to also indicate to the user which device has locked it, e.g. by an ID of the device (e.g. user device 311) which input the original lock command received in step S501.

In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored and/or distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A system comprising:

a controller configured to apply at least one illumination setting to at least one illumination source, thereby causing the illumination source to emit light according to the applied illumination setting;

electronic storage accessible to the controller; and a locking device configured to generate a lock command pertaining to the applied illumination setting, wherein the system is configured to mark the applied illumination setting as locked in the electronic storage in response to the lock command;

wherein the controller is configured to receive a control command pertaining to the applied illumination setting, and modify the applied illumination setting according to the received control command unless the applied illumination setting is marked as locked when the control command is received, such that the applied illumination setting is not modified in response to the received control command when the applied illumination setting is locked; and wherein the locking device is configured to generate the lock command when, via a user interface composing a plurality of user interface elements within a predetermined duration of an actuation of a user interface element that causes the illumination setting to be applied a further actuation of the same user interface element occurs.

2. A system according to claim 1, wherein the illumination source and the controller are embodied in a luminaire of the system, the control command being received at the luminaire.

3. A system according to claim 1, wherein the illumination source is embodied in a luminaire of the system, and the controller is embodied in a central control device of the system, wherein the control command is received at the central control device and the controller of the central control device is configured to modify the applied illumination setting by transmitting a message to the luminaire.

4. A system according to claim 1, wherein the controller is configured to receive a control command pertaining to an illumination setting, and identify a type of the control command;

wherein the controller is configured to modify the applied illumination setting according to a first type of control command only if the applied illumination setting is not marked as locked when that type control command is received; and wherein the controller is configured to modify the applied illumination setting according to a second type of control command irrespective of whether the applied illumination setting is marked as locked when that type of control command is received.

5. A system according to claim 4, wherein the controller is further configured for identifying the type by identifying whether the command was generated automatically or by a user, the first type of control command being an automatically-generated control command, and the second type of control command being a user-generated control command.

6. A system according to claim 4, wherein the controller is further configured for identifying the type by identifying a source of the control command.

7. A system according to claim 4, wherein the controller is further configured for identifying the type by determining whether the command complies with predetermined locking protocol rules, the first type of control command being a control command that does not comply with the predetermined locking protocol rules, the second type of control command being a control command that does comply with the predetermined locking protocol rules.

8. A system according to claim 1, wherein the system is configured, in response to a control command generated by the locking device and received at the controller when the applied illumination setting is marked as locked by the same locking device, to mark the applied illumination setting as unlocked, wherein the controller is configured to modify the applied illumination setting according to that control command from the locking device.

9. A system according to claim 1, wherein the system is configured to automatically mark the applied illumination setting as unlocked in response to expiration of an unlock duration from a time of it being marked as locked.

10. A system according to claim 1, wherein the locking device is further configured to generate an unlock command pertaining to the applied illumination setting, wherein the system is configured to unmark the applied illumination setting as locked in the electronic storage in response to the unlock command; and wherein the locking device is configured to generate the unlock command when yet a further actuation of the same user interface element that causes the illumination setting to be applied occurs within a predetermined duration of the actuation that causes the illumination setting to be applied or within a predetermined duration of the actuation that causes the illumination setting to be locked.

11. A system according to claim 1, wherein the user interface comprises a switch.

12. A system according to claim 11, wherein the switch comprises an on-off controller switch.

13. A computer program product comprising code stored on a non-transitory computer readable storage medium and configured when executed, partially on a controller and partially on a locking device of a lighting system according to claim 1.

14. A method of controlling an illumination source of a lighting system, the method comprising implementing by a controller of the lighting system the following steps:

applying an illumination setting to the illumination source;

receiving a control command pertaining to the applied illumination setting;

in response to the control command, accessing electronic storage to determine whether the applied illumination setting is marked as locked therein; and modifying the applied illumination setting according the received control command unless the applied illumination setting is marked as locked in the electronic storage when the control command is received, such that the applied illumination setting is not modified in response to the received control command when the applied illumination setting is locked, and the method further comprising implementing by a locking device of the lighting system the following step:

generating a lock command when, via user interface comprising a plurality of user interface elements, within a predetermined du ration of an actuation of a user interface element that causes the illumination setting to be applied a further actuation of the same user interface element occurs, the method further comprising implementing by the lighting system the following step:

marking the applied illumination setting as locked in the electronic storage in response to the lock command.

15. A method according to claim 14, wherein the method further comprises implementing by the locking device of the lighting system the following step:

in response to yet a further actuation of the same user interface element that causes the illumination setting to be applied occurs within a predetermined duration of the actuation that causes the illumination setting to be applied or within a predetermined duration of the actuation that causes the illumination setting to be locked, generating an unlock command, and wherein the method further comprises implementing by the lighting system the following step:

unmarking the applied illumination setting as locked in the electronic storage in response to the unlock command.

* * * * *